US007669715B2

(12) United States Patent
Wang

(10) Patent No.: US 7,669,715 B2
(45) Date of Patent: Mar. 2, 2010

(54) WASTEBASKET STRUCTURE

(75) Inventor: Long-Sheh Wang, Chia Yi (TW)

(73) Assignee: Chntuo Industrial Co., Ltd., Chia Yi (TW)

( * ) Notice: Subject to any disclaimer, the term of this patent is extended or adjusted under 35 U.S.C. 154(b) by 399 days.

(21) Appl. No.: 11/706,311

(22) Filed: Feb. 15, 2007

(65) Prior Publication Data

US 2008/0197030 A1 Aug. 21, 2008

(51) Int. Cl.
*B65D 71/00* (2006.01)
*B65D 83/10* (2006.01)

(52) U.S. Cl. ..... 206/581; 206/15.3; 206/349; 206/361; 15/257.2; 220/908

(58) Field of Classification Search ..... 206/581, 206/234, 361, 362, 362.1, 15.2, 15.3, 349; 15/257.1, 257.2; 220/23.83, 23.86, 23.87, 220/23.89, 254.3, 735, 736, 908, 908.1
See application file for complete search history.

(56) References Cited

U.S. PATENT DOCUMENTS 6,241,115 B1 * 6/2001 Delmerico et al. ..... 220/908
2004/0149608 A1 * 8/2004 Laux et al. ..... 206/349

* cited by examiner

*Primary Examiner*—Luan K Bui
(74) *Attorney, Agent, or Firm*—Rosenberg, Klein & Lee

(57) ABSTRACT

A wastebasket includes an outer container, an inner container housed in the outer container, and a lid positioned on top of the outer container; the outer container has a hollow detaining portion on an outer side thereof for holding a toilet brush and a plunger in position; the outer container has a bearing barrel held in the hollow detaining portion thereof for receiving the toilet brush; the outer container further has a receiving plate held adjacent to the hollow detaining portion in a lower end thereof for supporting the plunger as well as receiving foul water dripping from the plunger.

5 Claims, 7 Drawing Sheets

WASTEBASKET STRUCTURE

BACKGROUND OF THE INVENTION

1. Field of the Invention

The present invention relates to an improvement on a wastebasket structure, more particularly one, which consists of inner and outer containers, and which allows cleaning tools such as plungers and toilet brushes to be held in position therein.

2. Brief Description of the Prior Art

Domestic wastebaskets usually consist of a containing main body, and a lid. And, domestic wastebaskets with inner and outer containing members are also available, which are usually used in bathrooms. Furthermore, toilet brushes and plungers are usually placed next to wastebaskets in the bathrooms. Because toilet brushes and plungers aren't covered or positioned in any containers, stinking odor will escape from them if they aren't thoroughly cleaned after they are used. In addition, the toilet brushes and the plungers will occupy relatively much space in the bathrooms, which are usually relatively small, if they are positioned next to the wastebaskets.

In order to overcome the above-mentioned problem, the inventor of the present invention invented an "IMPROVEMENT ON WASTEBASKET STRUCTURE", for which U.S. patent application was filed on 4 Aug. 2006, and patent Ser. No. 11/498,893 was granted.

The improvement on wastebasket structure includes an outer container, an inner container, and a lid; the outer container has a holding room therein, and an internal receiving hollowness for a plunger to be located on; the inner container is held in the holding room, and the lid is positioned on top of the outer container; the outer container further has an internal fitting cavity next to a border thereof; a bearing member is fitted in the internal fitting cavity for a toilet brush to be located in.

And, it is a main object of the present invention to provide an improvement on a wastebasket to provide users with still more convenience.

SUMMARY OF THE INVENTION

A wastebasket according to an embodiment of the present invention includes an outer container, an inner container housed in the outer container, and a lid positioned on top of the outer container; the outer container has a hollow detaining portion on an outer side thereof for holding a toilet brush and a plunger in position; the outer container has a bearing barrel held in the hollow detaining portion thereof for receiving the toilet brush; the outer container further has a receiving plate held adjacent to the hollow detaining portion in a lower end thereof for supporting the plunger as well as receiving foul water dripping from the plunger. Therefore, the wastebasket helps people save space and maintain hygiene.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
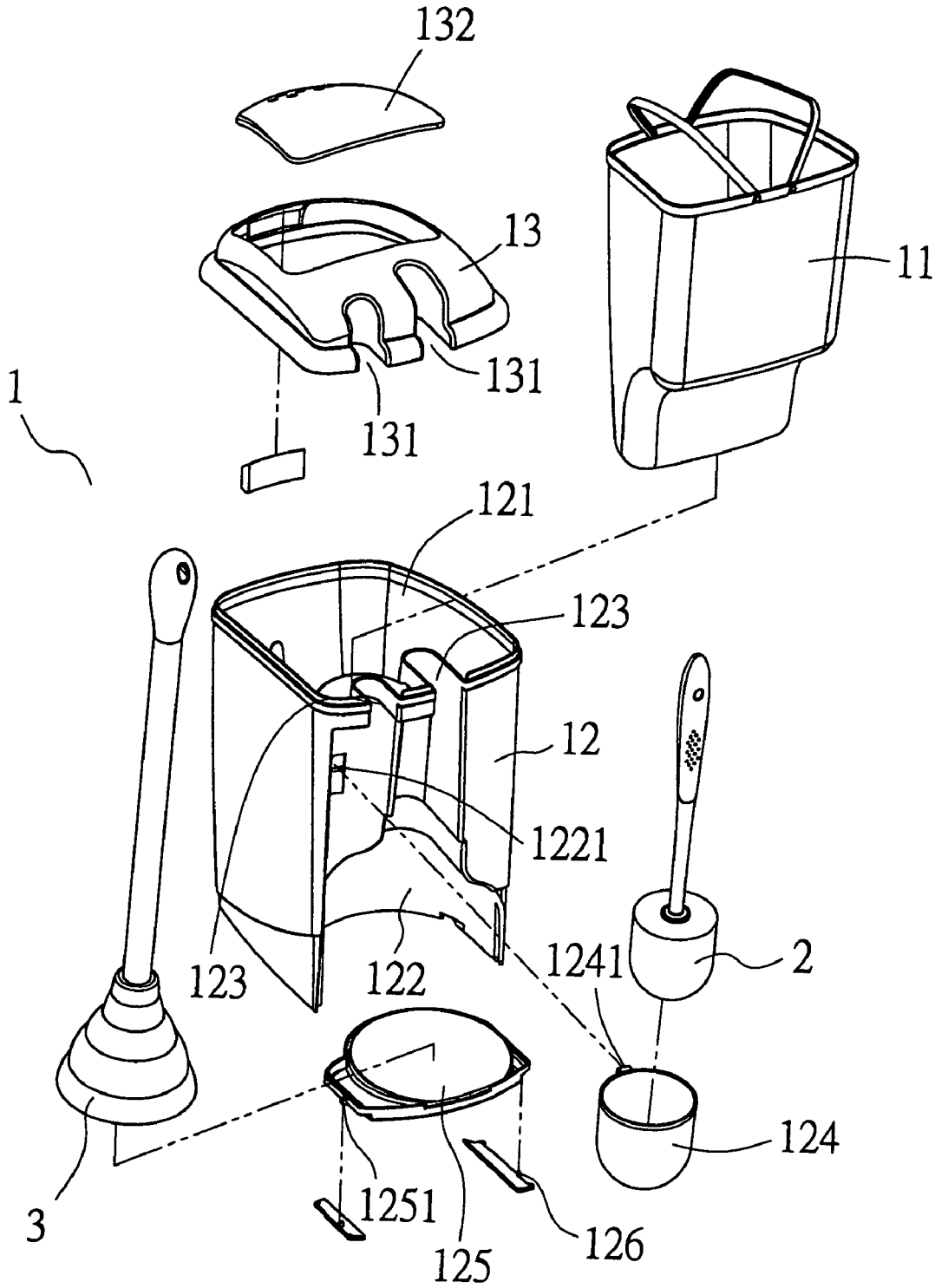
FIG. 1 is an exploded perspective view of the present invention.

Referring to FIG. 1, a first preferred embodiment of a wastebasket of the present invention includes an inner container 11, an outer container 12, and a lid 13.

The outer container 12 has a holding room 121 therein, and the inner container 11 is held in the holding room 121. The lid 13 is disposed on top of the outer container 12 for covering the outer container 12.

Figure 2:
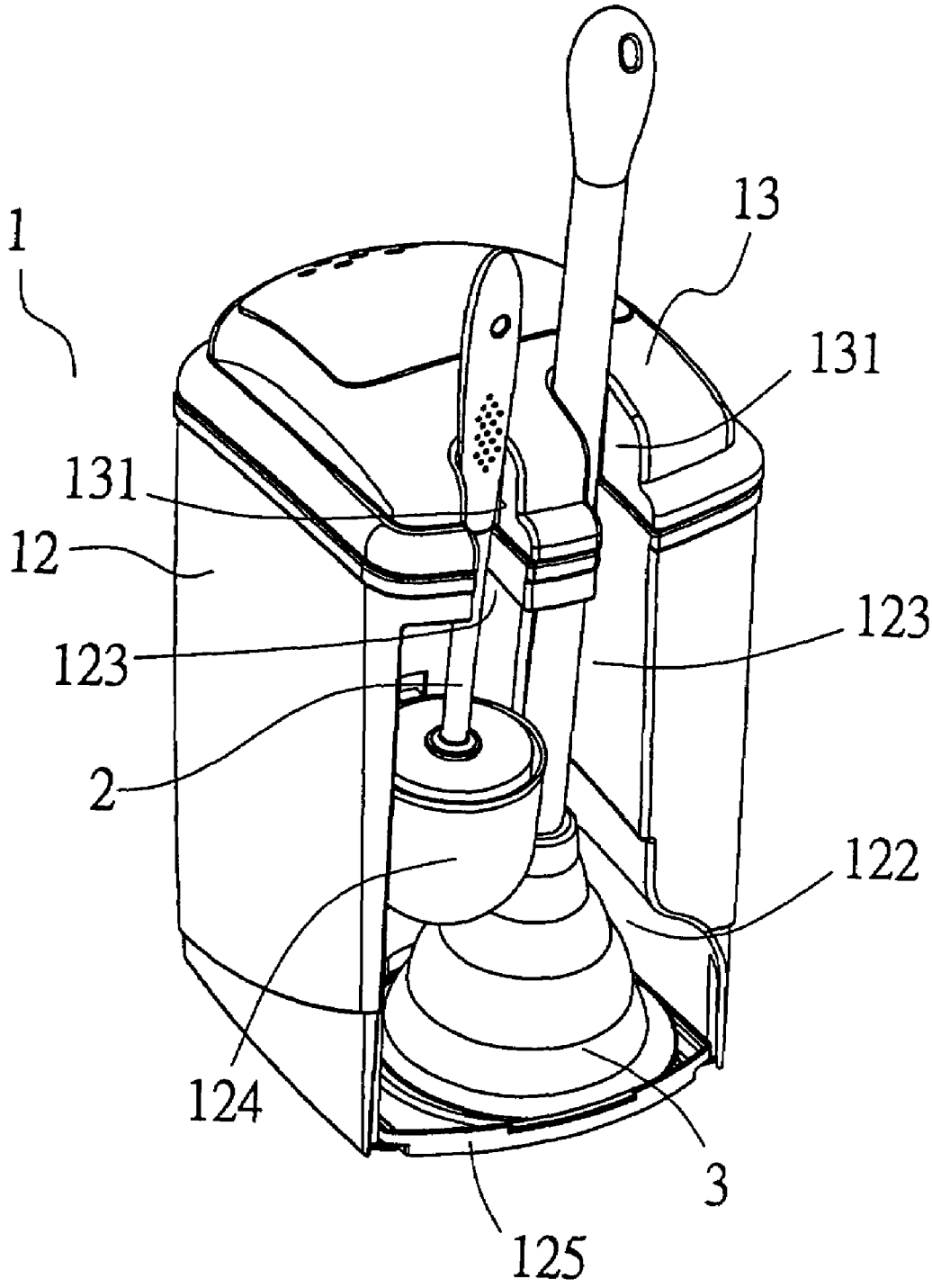
FIG. 2 is a perspective view of the present invention.

Referring to FIG. 2, the outer container 12 has a hollow detaining portion 122 on an outer side thereof, which has two receiving slots 123 in alignment with receiving slots 131 in the lid 13. A bearing barrel 124 is fitted in the hollow detaining portion, and a receiving plate 125, which is provided for receiving foul water, is positioned next to the hollow detaining portion 122 in a lower end of the outer container 12.

The lid 13 has two receiving slots 131 corresponding to the receiving slots 123 of the hollow detaining portion 122 of the outer container 12 respectively. The handles of a toilet brush 2 and a plunger 3 can be received in the receiving slots 131, and gripped by the lid 13 when the toilet brush 2 and the plunger 3 are positioned in the hollow detaining portion 122 of the outer container 12.

Figure 3:
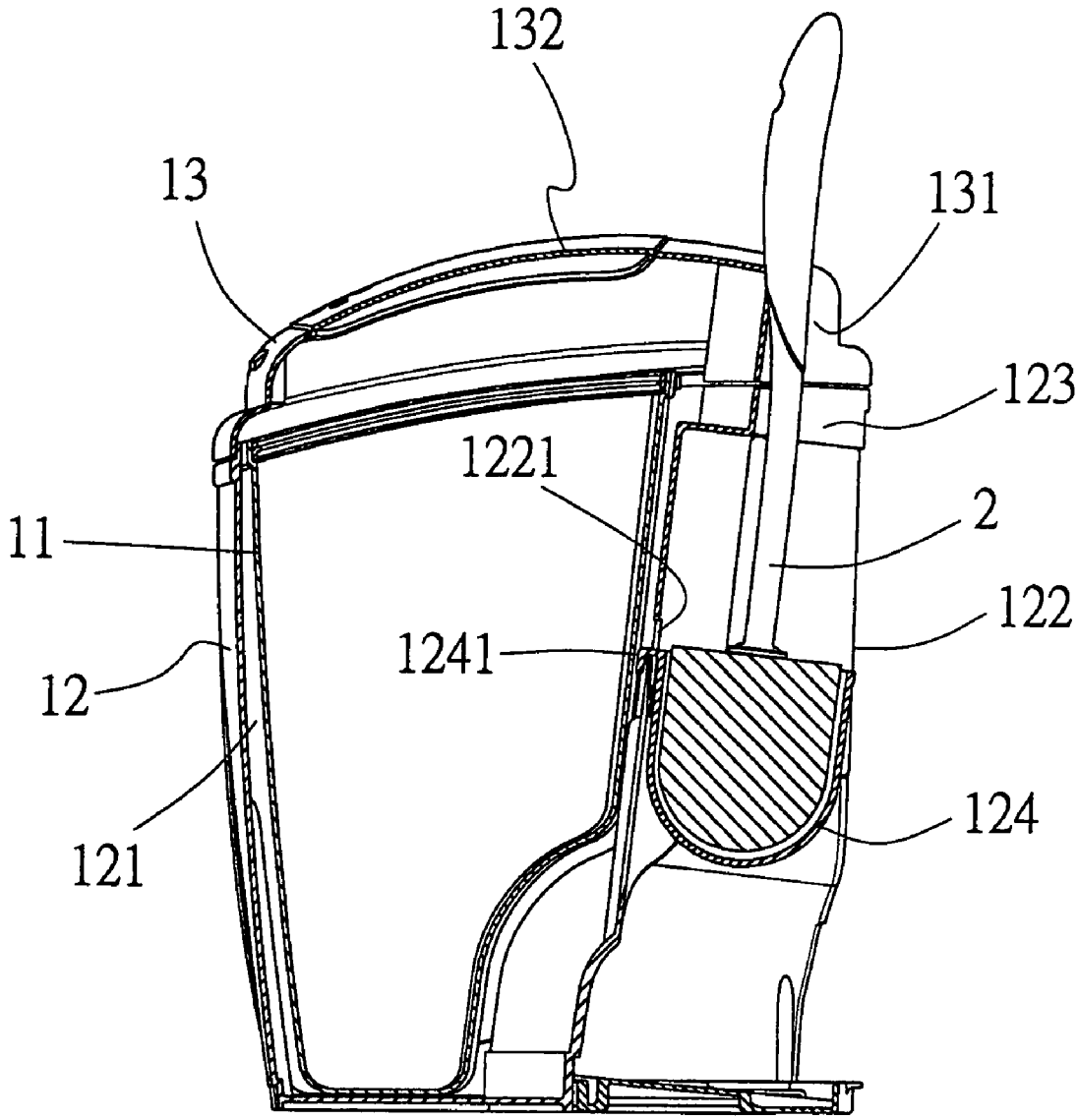
FIG. 3 is a sectional view of the present invention (1)
Figure 4:
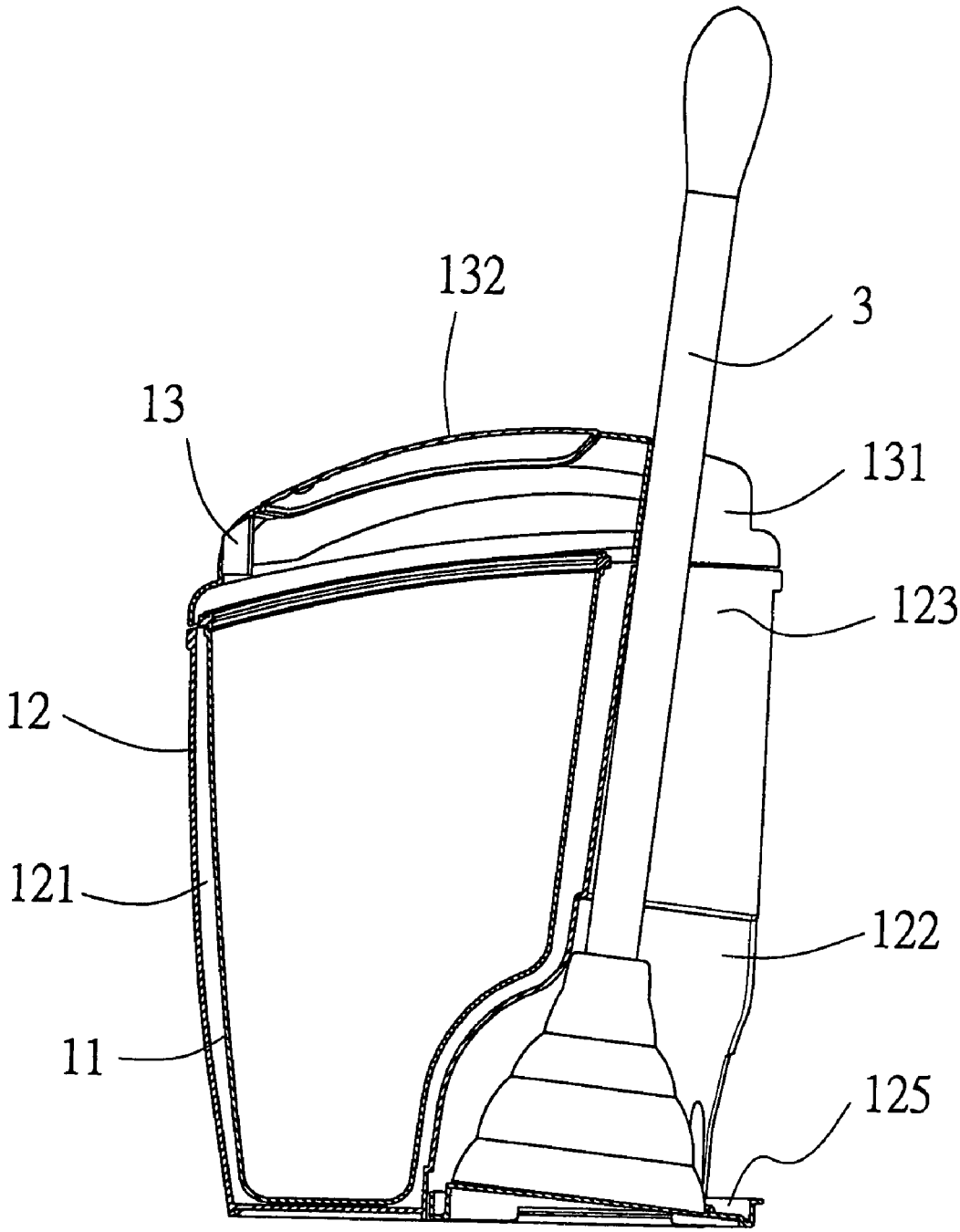
FIG. 4 is a sectional view of the present invention (2)

Referring to FIG. 3, the inner container 11 is tightly held in the holding room 121 of outer container 12, and the bearing barrel 124 is fitted in the hollow detaining portion 122. Referring to FIG. 4, the receiving plate 125 is positioned next to the hollow detaining portion 122 in a lower end of the outer container 12. The handle of a toilet brush 2 is received by one of the receiving slots 131 of the lid 13, and the brush head is received in the bearing barrel 124. The handle of a plunger 3 is received by the other gap 131 of the lid 13, and the plunger head is supported on the receiving plate 125 held in the lower end of the outer container 12. Thus, the handles of the toilet brush 2 and the plunger 3 are gripped by the lid 13.

Therefore, the toilet brush 2 and the plunger 3 can be easily taken and used, and they can be easily stored in the hollow detaining portion 122 of the outer container 12 of the wastebasket with handle portions thereof being fitted in the gaps 131 and gripped by the lid 13; thus, foul water dripping from the plunger 3 will be received in the receiving plate 125, preventing the toilet from being dirtied by foul water.

Referring to FIG. 3, the hollow detaining portion 122 further has a gap 1221, and the bearing barrel 124 has a hooked portion 1241. The bearing barrel 124 is secured in position with the hooked portion 1241 thereof being fitted in the gap 1221 of the hollow detaining portion 12.

Figure 5:
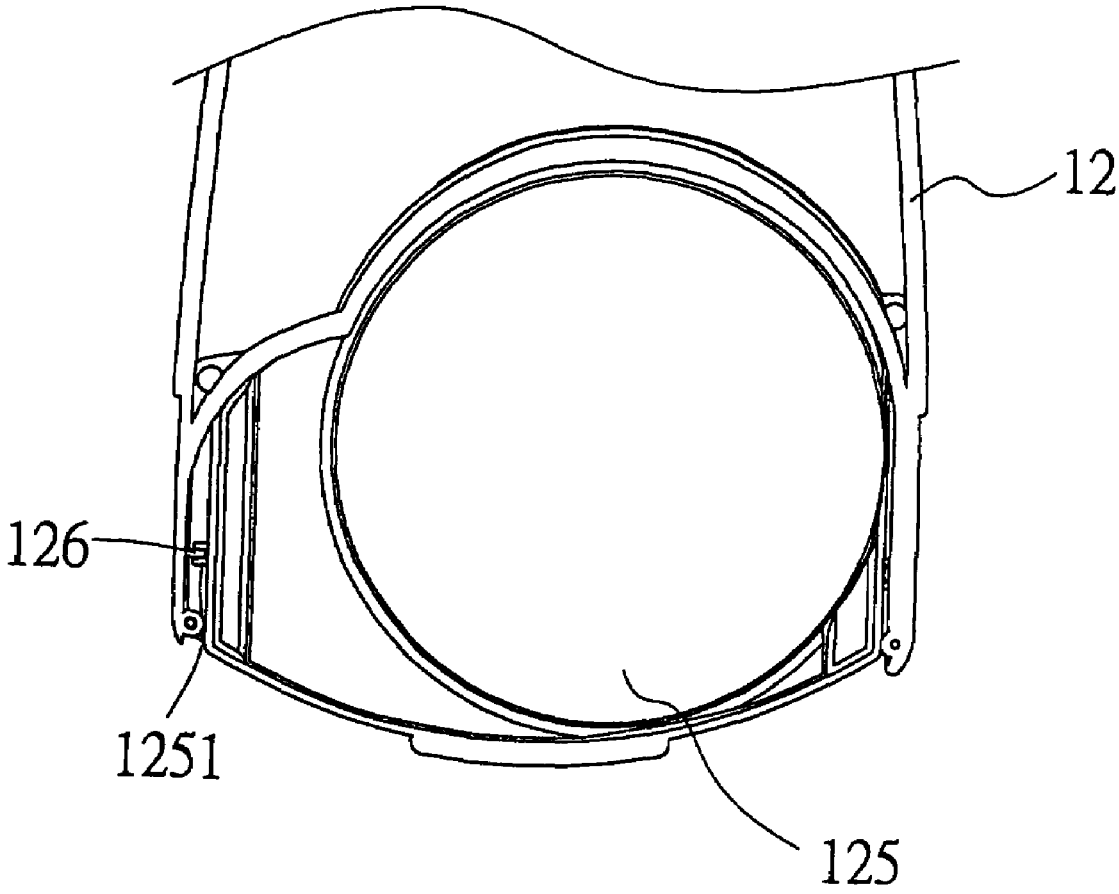
FIG. 5 is a horizontal sectional view of the present invention.

The bearing barrel 124 can be firmly held in the outer container 12 either without any securing means or with proper securing means; referring to FIG. 5, the outer container 12 has connecting pieces 126 on an inner side of the lower portion, and the receiving plate 125 has rail-shaped connecting protrusions 1251. The receiving plate 125 is firmly held in the lower end of the outer container 12 with the rail-shaped connecting protrusions 1251 being joined to the connecting pieces 126 of the outer container 12.

Referring to FIG. 1 again, the lid 13 includes a pivotal cover part 132 right above the inner container 11; thus, waste can be easily put into the inner container 11.

Figure 6:
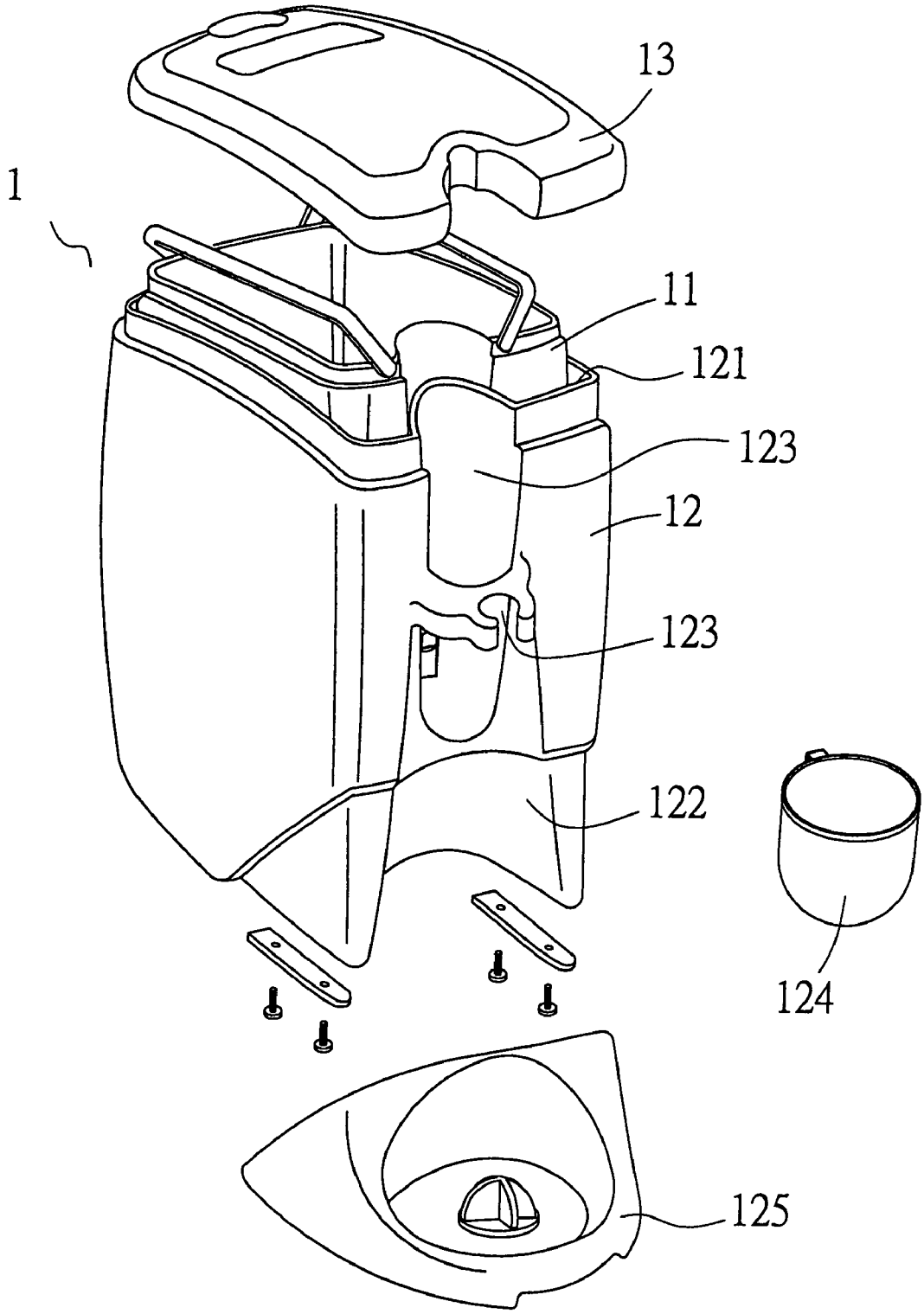
FIG. 6 is an exploded view of the second preferred embodiment.

Referring to FIG. 6, a second preferred embodiment of a wastebasket includes an inner container 11, an outer container 12, and a lid 13. The outer container 12 has a holding room 121, in which the inner container 11 is held.

Figure 7:
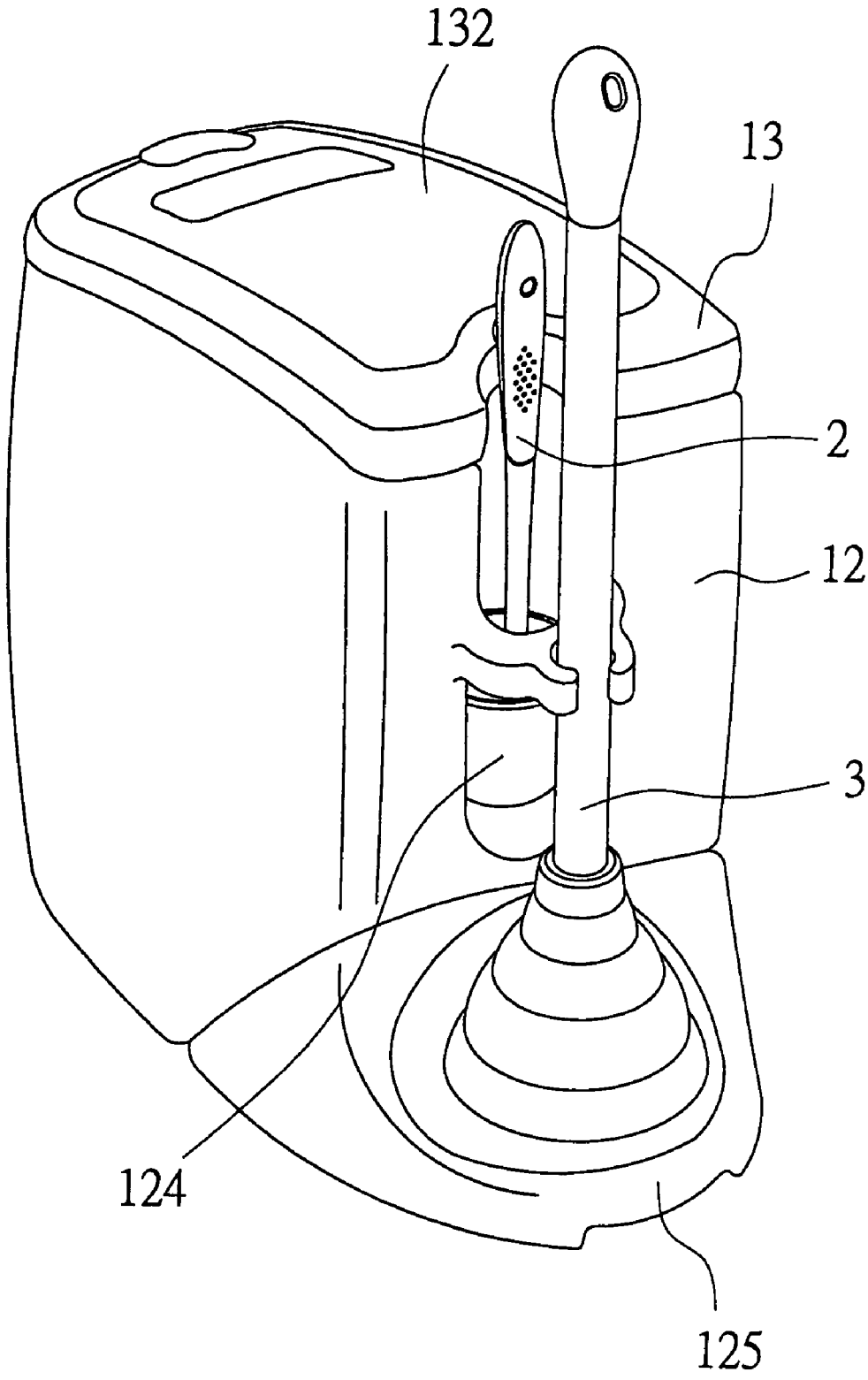
FIG. 7 is a perspective view of the second embodiment.

Referring to FIG. 7, the outer container 12 has a hollow detaining portion 122, which has two receiving slots 123 in alignment with similar slots in the lid 13. A bearing barrel 124 is fitted in the hollow detaining portion 122, and a foul water receiving plate 125 is positioned under the hollow detaining portion 122 at a lower end of the outer container 12. The lid 13 has receiving slots 131 right above and in alignment with the receiving slots 123 of the outer container 12. To store a toilet brush 2 and a plunger 3 on the wastebasket, the toilet brush 2 is received by a receiving slot 131 on the lid 13 in alignment with one of the receiving slots 123 on the outer container 12 so as to be gripped by the lid 13 at a handle portion thereof. The plunger 3 is also received by aligned receiving slots on the lid and the outer container, and gripped by the hollow detaining portion 122 at a handle portion thereof.

From the above description, it can be seen that the present invention has the following advantages:

1. The wastebasket of the present invention has the hollow detaining portion for holding a plunger and a toilet brush. Therefore, the plunger and the toilet brush can be easily stored so as to occupy relatively little space in toilet, and they can be easily taken and used.

2. The wastebasket has the bearing barrel in the hollow detaining portion thereof. Therefore, a toilet brush can be hidden in the bearing barrel for preventing foul water dripping from the toilet brush from flowing out to dirty the environment.

3. The wastebasket of the present invention has the receiving plate under the hollow detaining portion in the outer container. Therefore, a plunger can be supported on the receiving plate for preventing foul water from dripping and flowing outside.

4. A plunger and a toilet brush can be respectively positioned in a left portion and a right portion of the hollow detaining portion of the outer container. Or alternatively, they can be positioned in a front portion and a rear portion of the hollow detaining portion.

What is claimed is:

1. An improvement on a wastebasket structure, comprising:

an outer container, the outer container having a holding room therein; the outer container having a hollow detaining portion on an outer side thereof; the outer container having a removable bearing barrel held in position in the hollow detaining portion thereof; the outer container having a receiving plate held adjacent to the hollow detaining portion in a lower end thereof for receiving foul water;

a removable inner container held in the holding room of the outer container for storage of waste material; and a lid disposed on the outer container for covering the outer container, the lid having at least one receiving slot in alignment with the hollow detaining portion of the outer container for receiving handles of a toilet brush and a plunger when said toilet brush and plunger are held in the hollow detaining portion of the outer container.

2. The improvement on a wastebasket structure as recited in claim 1, wherein the hollow detaining portion of the outer container has at least one receiving slot facing and in alignment with said at least one receiving slot of the lid for allowing said toilet brush and plunger handles to be received and said toilet brush and plunger to be held in the hollow detaining portion of the outer container.

3. The improvement on a wastebasket structure as recited in claim 1, wherein the lid includes a pivotal cover part for allowing open communication with the inner container.

4. The improvement on a wastebasket structure as recited in claim 1, wherein the hollow detaining portion of the outer container has a gap, and the bearing barrel has a hooked portion; the bearing barrel being secured in position with the hooked portion thereof being fitted in the gap of the hollow detaining portion.

5. The improvement on a wastebasket structure as recited in claim 1, wherein the outer container has plural connecting pieces thereon, and the receiving plate has plural rail-shaped connecting protrusions; the receiving plate being held in position with the rail-shaped connecting protrusions being joined to the connecting pieces of the outer container.

* * * * *